US006928848B2

(12) United States Patent
Golovashchenko et al.

(10) Patent No.: US 6,928,848 B2
(45) Date of Patent: Aug. 16, 2005

(54) FLANGING PROCESSES WITH RADIAL COMPRESSION OF THE BLANK STRETCHED SURFACE

(75) Inventors: Sergey Fedorovich Golovashchenko, Beverly Hills, MI (US); Andrei Viktorovich Vlassov, Moscow (RU); Sergey Sergeyevich Kolesov, Dearborn, MI (US); Vladimir Grigorievich Kondratenko, Moscow (RU)

(73) Assignee: Ford Motor Company, Dearborn, MI (US)

( * ) Notice: Subject to any disclaimer, the term of this patent is extended or adjusted under 35 U.S.C. 154(b) by 11 days.

(21) Appl. No.: 10/249,276

(22) Filed: Mar. 27, 2003

(65) Prior Publication Data

US 2004/0187542 A1 Sep. 30, 2004

(51) Int. Cl.[7] ..... B21D 39/02
(52) U.S. Cl. ..... 72/322; 72/306; 29/243.58
(58) Field of Search ..... 72/322, 306, 386, 72/312–315; 29/243.58, 243.57

(56) References Cited

U.S. PATENT DOCUMENTS

| | | | | |
|---|---|---|---|---|
| 2,973,796 A | * | 3/1961 | Mace et al. | 72/315 |
| 4,928,388 A | | 5/1990 | Dacey, Jr. | |
| 4,942,753 A | | 7/1990 | Willeke | |
| 5,150,508 A | | 9/1992 | St. Denis | |
| 5,224,253 A | | 7/1993 | Sawa | |
| 5,315,855 A | | 5/1994 | Jackson | |
| 5,357,665 A | | 10/1994 | Fukui et al. | |
| 5,454,261 A | | 10/1995 | Campian | |
| 5,548,883 A | | 8/1996 | Saijo et al. | |
| 5,740,691 A | * | 4/1998 | Kovarovic et al. | 72/306 |
| 5,934,133 A | * | 8/1999 | Takahashi et al. | 72/306 |
| 5,948,185 A | | 9/1999 | Krajewski et al. | |
| 6,295,858 B1 | * | 10/2001 | Torito | 72/315 |
| 6,425,277 B2 | | 7/2002 | Wiens | |
| 6,460,392 B2 | * | 10/2002 | Wiens et al. | 72/306 |
| 6,739,169 B2 | * | 5/2004 | Baulier | 72/312 |

FOREIGN PATENT DOCUMENTS

| | | |
|---|---|---|
| JP | 61-262432 | 11/1986 |
| JP | 1-309734 | * 12/1989 |
| JP | 5-253626 | * 10/1993 |
| JP | 2000-51958 | * 2/2000 |

OTHER PUBLICATIONS

David A. Smith, Die Design Handbook, Third Edition, pp. 14–1–14–22.

M. Yajima et al., The Effects of Hydrostatic Pressure on the Ductility of Metals and Alloys, Int. Journ. of Fracture Mech., 6 (1970) pp. 139–150.

P. W. Bridgman, Studies in Large Plastic Flow and Fracture, Harvard University Press, Cambridge, MA 1964, pp. 48–73.

* cited by examiner

*Primary Examiner*—Daniel C. Crane
(74) *Attorney, Agent, or Firm*—Raymond L. Copplellie; Brooks Kushman P.C.

(57) ABSTRACT

A method and tool for forming a hem flange. A larger radius bend is initially formed when a pre-hem flange is formed. A sharper radius bend is subsequently formed when the flange is formed. After the flange is formed, conventional hem forming methods and tools may be used to complete formation of a hem that may be used to join inner and outer panels.

19 Claims, 5 Drawing Sheets

FLANGING PROCESSES WITH RADIAL COMPRESSION OF THE BLANK STRETCHED SURFACE

BACKGROUND OF INVENTION

1. Field of the Invention

The present invention relates to a tool for forming a hem flange.

2. Background Art

Vehicle body panels such as deck lids, hoods, doors and the like frequently include inner and outer panels that are secured together by means of a hem that extends about their periphery. Such body panels have traditionally been manufactured from steel sheet metal panels. Steel is very ductile and is easily formed in a hem forming operation. Increasingly, automotive manufacturers are turning to aluminum to obtain weight savings for vehicle body panels. Aluminum alloys offer a high strength/low weight alternative to steel.

Aluminum does not, however, have the same degree of ductility and resistance to work hardening offered by steel. Forming a hem on a sheet metal body panel made of aluminum is more difficult than forming the same hem with steel due to aluminum's reduced ductility in comparison to steel. One proposed solution to this problem was to form a larger radius hem when making body panels of aluminum sheet metal. Larger radius hems result in lower fit and finish ratings because larger radius hems cause gaps between door closure panels and their openings appear larger. Further, the low ductility of aluminum may cause tears or splits starting from the outer surface of a hem. Tears and splits result in high part rejection rates and unacceptable scrap rates.

Substantial work hardening may occur during the hem flange formation process. The hem flange formation process is the initial step in forming a hem wherein a peripheral portion of a blank or drawn part is bent to about 90°. Forming a 90° bend in an aluminum sheet around a relatively tight radius causes substantial amounts of deformation. This amount of strain results in splits and even tears as the hem flange is further formed in pre-hem and final hem forming steps.

These and other problems are addressed by applicants' invention as summarized below.

SUMMARY OF INVENTION

According to one aspect of the present invention, a method of forming a hem flange for securing a sheet metal outer panel to an inner panel is provided. The method comprises retaining a sheet metal blank on a first die with a peripheral portion of the sheet metal blank initially extending outboard of a first flange forming portion. The first flange forming portion has a first supporting portion, a first flange pre-forming surface, and a first radiused portion. A first bender is moved in a direction normal to the initial sheet metal blank surface and into engagement with the peripheral portion of the sheet metal blank. The first bender bends the peripheral portion over the first radiused portion and against the flange pre-forming surface to form a sheet metal blank with a partially formed flange. The sheet metal blank including the partially formed flange is secured to a second die with the partially formed flange of the sheet metal blank initially extending outboard of a second flange forming portion. The second flange forming portion of the second die has a second supporting portion, a second flange forming surface, and a second radiused portion. The second radiused portion has a tighter radius than the first radius. A second bender die is moved into engagement with the partially formed flange to form the partially formed flange against the second flange forming surface in and around the second radiused portion by moving at an angle relative to the sheet metal blank surface that is at least partially directed toward the second flange forming surface.

According to another aspect of the method of the present invention, a method of forming a hem flange is provided wherein a sheet metal part having a body portion and a flange portion is clamped in a hem flange forming tool with the body portion clamped in the hem flange tool and the flange portion extending outboard of the tool. The flange portion is bent to form a relatively larger radius bend in the sheet metal part between the main body portion and the flange portion by contacting the flange portion with a movable tool. The flange portion is then further bent to form the larger radius bend into a sharp radius bend with the flange portion being disposed at a right angle relative to the body portion by moving the movable tool from a position outboard of the tool inwardly toward the tool.

According to another aspect of the invention, a flanging tool for forming a hem flange is provided. The flanging tool includes a first pre-form die having a flange pre-forming surface comprising a blank supporting surface, a flange pre-forming surface, and a first radius therebetween. A first flanging punch having a first clamping portion holds the sheet metal blank on the first pre-form die and a first outer portion of the first flanging punch moves relative to the first pre-form die. The sheet metal blank has a peripheral portion that extends outboard of the first pre-form die and the first clamping portion. The first outer portion of the first flanging punch engages the peripheral portion of the sheet metal blank and forms a pre-form flange from the peripheral portion. A first flange die is provided that has a flange forming surface comprising a second blank supporting surface, a flange pre-form forming surface, and a second radius therebetween. A second flanging punch has a second clamping portion that holds the sheet metal blank with the pre-form on the first flange die. A second outer portion moves relative to the first flange die and the second clamping portion. The pre-form flange of the sheet metal blank initially extends outboard of the second blank supporting surface and clamping portion, wherein the second outer portion engages the pre-form flange and forms a flange on the blank from the pre-form flange.

According to other aspects of the invention, the bending steps may be performed by a flange tool or may also be formed by a roll former or hammer. The pre-form may be formed by a flange tool moving perpendicular to the plane of the sheet metal blank or may alternatively be moved in an angular direction relative to the sheet metal blank surface. Bending the pre-form flange may be performed by a tool that moves at an angle to or perpendicular to the surface of the sheet metal blank so that a compressive force is applied to the stretched surface of the sheet metal blank. The wide radius of the pre-form flange may be 2 to 3 mm or, stated another way, may be two to three times the thickness of the metal forming the blank. The sharp radius may be formed to 0.5 mm or, stated another way, may be the radius of one-half the thickness of the sheet metal forming the blank.

DETAILED DESCRIPTION

Figure 1A:
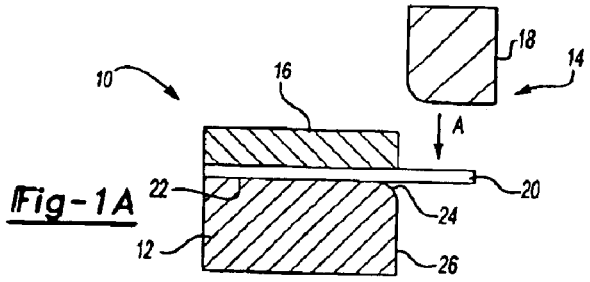
FIGS. 1A through 1D are schematic cross-sectional views of final flange forming steps that illustrate a flange forming process for forming a flange according to the present invention.

Referring now to the drawings, FIGS. 1A through 1D are related as steps in a process for forming a flange on a panel for a hem. In FIG. 1A pre-flange tool 10 is shown to include a lower die 12 and an upper die 14. Upper die 14 includes a clamping portion 16 and a bending member 18, or flanging punch. The clamping portion 16 clamps the sheet metal blank 20 to the lower die 12 during pre-flange process. Bending member 18 acts on a peripheral portion of the sheet metal blank 20. Bending member 18, as indicated by the directional arrow "A", wipes the sheet metal blank 20 to form it against the lower die 12. Lower die 12 includes a supporting portion 22 that supports the sheet metal blank 20 and a large radius portion 24 over which the sheet metal blank 20 is initially formed to impart a larger radius bend in the sheet metal blank 20. A forming portion 26 of the lower die 12 is a surface against which the sheet metal blank 20 is formed as the bending member 18 forces it against the lower die 12.

Figure 1B:
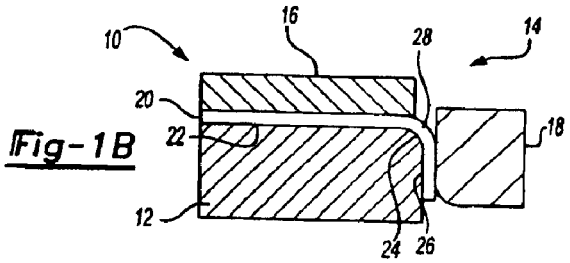

Referring now to FIG. 1B, the same pre-flange tool 10 is shown at a point in the cycle wherein the bending member 18 has completed forming the sheet metal blank 20 against the large radius 20 and forming portion 26 of the lower die 12. A partial flange 28 is shown as it is initially formed in the pre-flange tool 10.

Figure 1C:
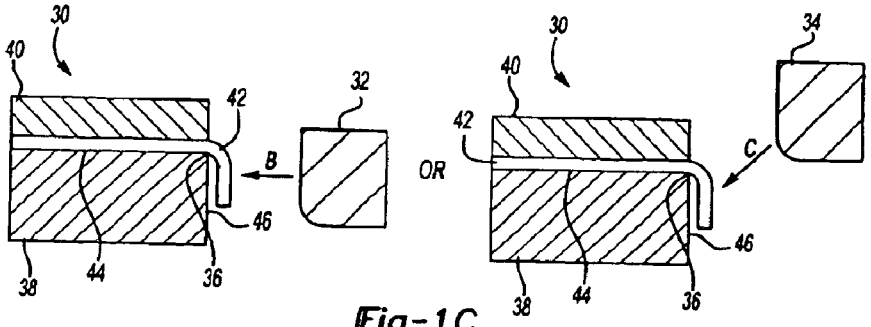

Referring now to FIG. 1C, two alternative embodiments of a flange tool 30 are shown. On the left side of FIG. 1C, a flange tool 30 is provided with a lateral bender 32 that moves in a lateral direction as shown by the directional arrow "B". On the right side of FIG. 1C, an alternative embodiment is shown wherein the flange tool 30 is provided with an angularly moved bender 34 and moves in the direction of the arrow "C" as indicated. In each embodiment shown in FIG. 1C, a sharp radius 36 is formed on the lower die 38. Clamping member 40 clamps the sheet metal blank with a partial flange 42 between the clamping member 40 and lower die 38. The lower die 38 includes a supporting portion 44 that supports the sheet metal blank 42 as shown with the partially formed flange spaced from a flange forming portion 46 of the lower die 38. The lateral bender 32 or angularly moved bender 34 engages the partial flange of the sheet metal blank 42 and drives it with radial pressure being applied to the stretched surface into engagement with the flange forming portion 46.

Figure 1D:
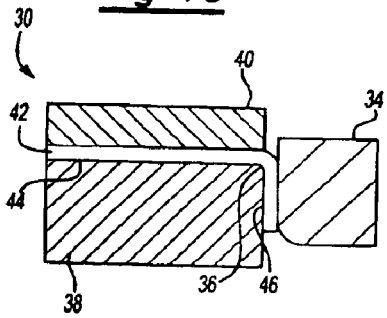

As shown in FIG. 1D, the angularly moved bender 34 is shown driving the sheet metal blank with partial flange 42 into engagement with the flange forming portion 46 causing it to follow the sharp radius 36 on the lower die 38.

In this way, a flange suitable for hemming in conventional hem forming processes is provided that has a sharp radiused flange formed in two steps. In the first step, the sheet metal blank 20 is formed around a relatively large radius 24 that applies a lower level of strain to the sheet metal blank and enables the process to be applied to aluminum alloy having limited ductility. After the pre-flanging operation, the partially formed flange is formed by means of either lateral bender 32 or the angularly moved bender 34 that apply a compressive force to the stretched side of the flange as the flange is formed around the sharp radius 36. The compressive force applied to the flange improves its ductility characteristics and minimizes any tendency of the material to split or otherwise show signs of strain as it is formed around sharp radius 36.

Figure 2A:
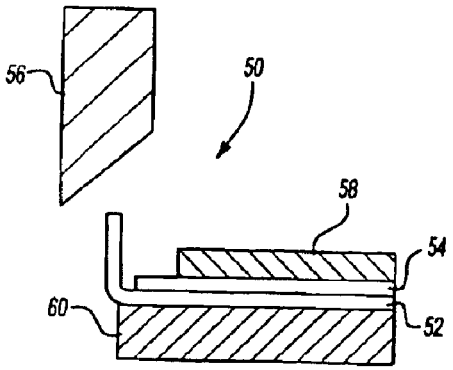
FIGS. 2A through 2D are schematic cross-sectional views that illustrate further processing steps used to form a flat hem after initial forming of the flange according to the present invention.

Referring now to FIGS. 2A through 2D, a conventional hem forming process is shown wherein a panel having a sharp radius flange is formed to provide a flat hem in a pre-hemming and final hemming tool. Referring now to FIG. 2A, pre-hem tool 50 is shown with an outer panel 52 and an inner panel 54. A flange bender 56 is shown above the distal end of the hem flange while a clamping element 58 holds the outer panel 52 and inner panel 54 against the base 60.

Figure 2B:
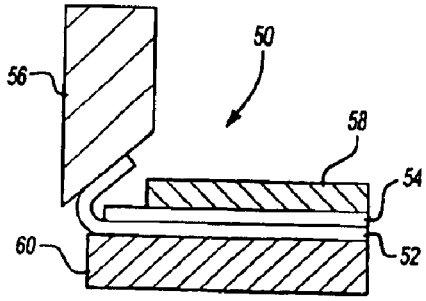

Referring now to FIG. 2B, the pre-hem tool 50 is shown forming the pre-hem on the outer panel 52. The hem flange is formed to an approximate 45° angle relative to the outer portions of outer panel 52.

Figure 2C:
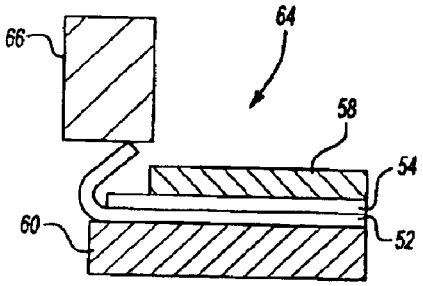
Figure 2D:
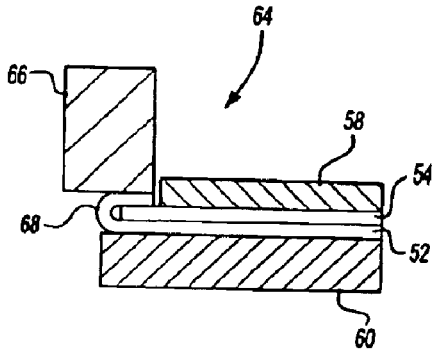

Referring now to FIG. 2C, a final hem tool is shown operating on the outer panel 52 and inner panel 54 that are clamped by clamping element 58 into engagement with the base 60. The hem bender 66 in FIG. 2C is shown as it initially contacts the hem flange. In FIG. 2D, the hem bender 66 is shown completing the formation of the hem joint 68. Hem joint 68 is a flat hem that joins the outer panel 52 and inner panel 54 together with a tight radius hem joint 68.

Referring now to FIGS. 3A through 3D, an alternative embodiment of the invention is shown wherein a one step flange forming tool 70 is provided. The one step flange forming tool 70 acts on a sheet metal blank 72 that is captured between a lower die 74 and a clamping element 76. A peripheral portion of the sheet metal blank terminates in a distal end 78. The distal end 78 is contacted by a radiused corner 80 moving in the direction indicated by directional arrow "D" that causes the sheet metal blank to bend around a bending radius 82.

Figures 3A, 3B, 3C, 3D:
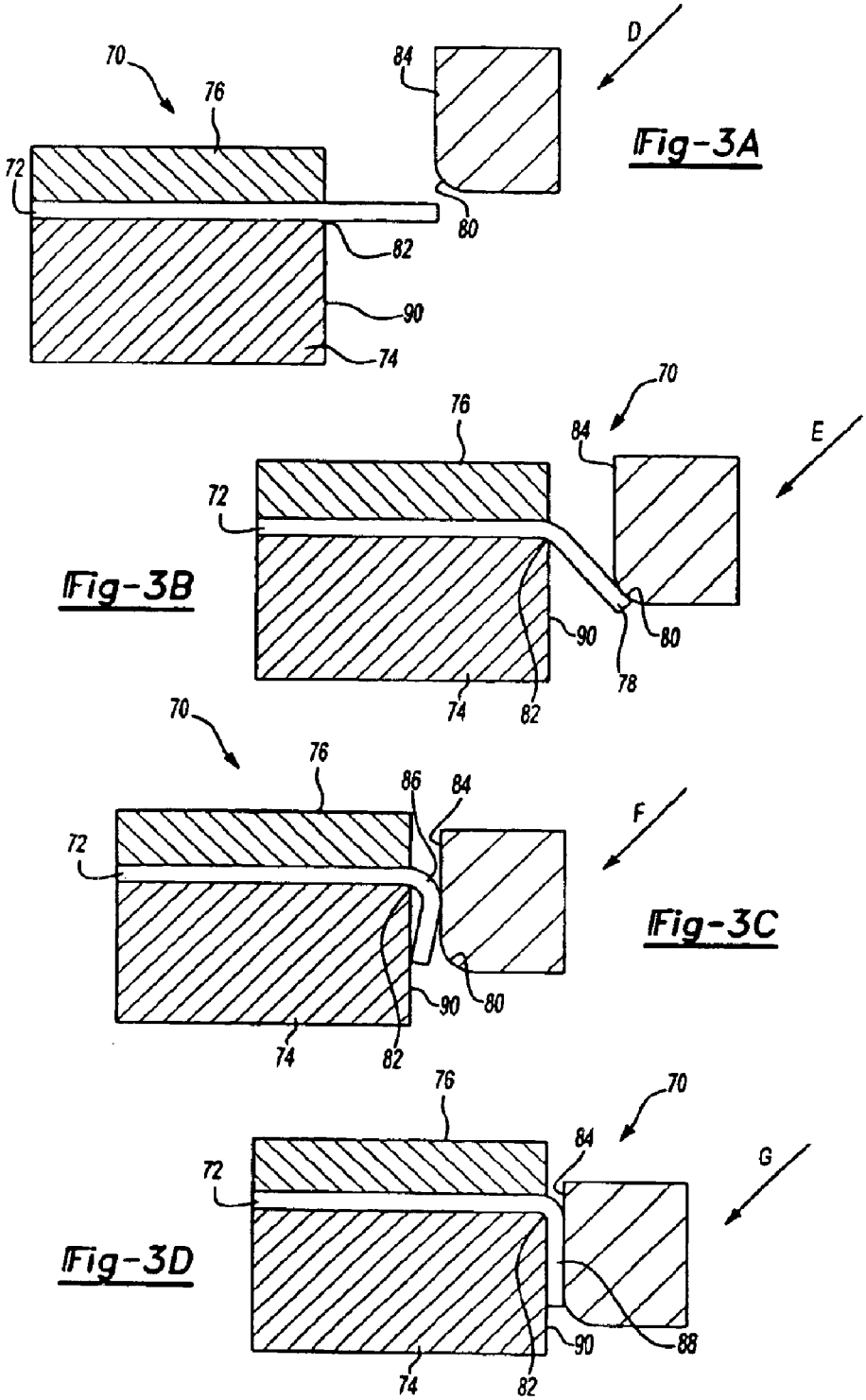
FIGS. 3A through 3D are schematic cross-sectional views that illustrate a one-step flange forming process wherein a flange forming tool is moved at an acute angle relative to the sheet metal blank to be formed.

As shown in FIG. 3B, the radiused corner 80 contacts the distal end 78 and applies a force in the direction reflected by the directional arrow "E".

Referring now to FIG. 3C, the point of contact transitions from the radiused corner 80 to the forming surface 84 with the tool moving in the direction indicated by arrow "F" as the flange is formed until it forms an over-bend 86 as shown in FIG. 3C. The over-bend 86 has a larger radius then the bending radius 82.

Referring now to FIG. 3D, the final flange 88 is shown with the forming surface 84 driving the final flange 88 in the direction indicated by arrow "G" into contact with the flange forming surface 90. In the latter stages of the bending process reflected by FIGS. 3C and D, a compressive force is applied to the stretched surface of the flange as it is driven to form a sharp radius flange.

Figure 4A:
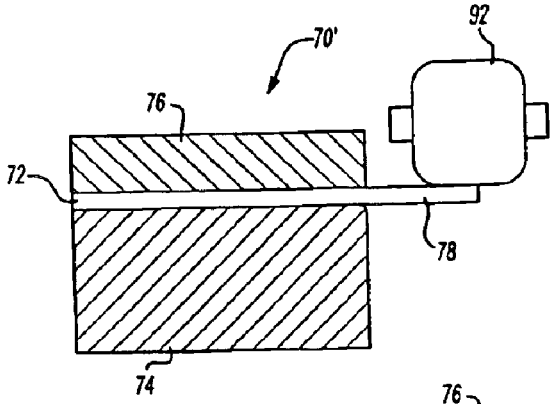
FIGS. 4A through 4D are schematic cross-sectional views that illustrate a flange forming process wherein a roll forming tool is used to form a hem flange in a sheet metal blank according to the present invention.
Figure 4B:
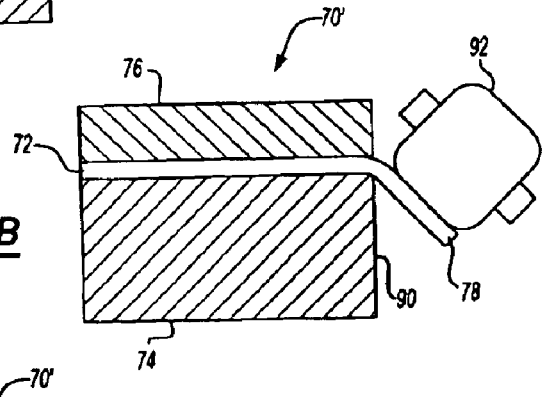
Figure 4C:
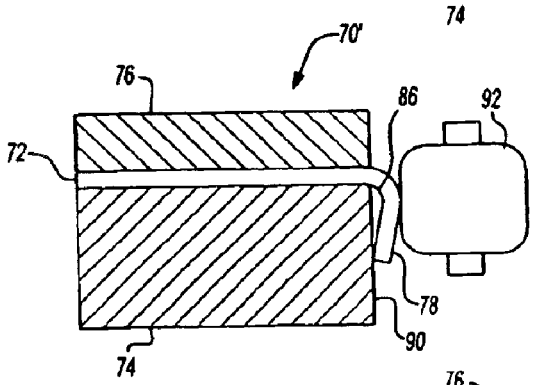
Figure 4D:
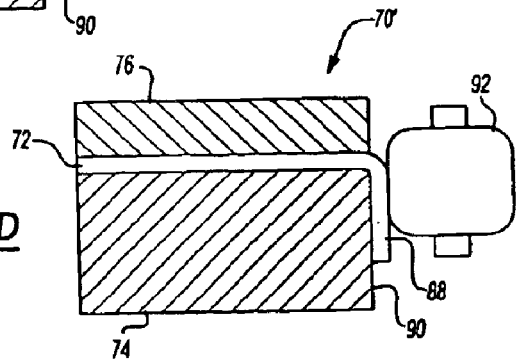

Referring now to FIGS. 4A through D, an alternative embodiment of the one step flange forming tool 70' shown. In FIGS. 4A through D, similar reference numerals are used to refer to components that are similar to those shown at FIGS. 3A through D. The one step flange forming tool 70' uses a roll former 92 to form the flange in the sheet metal blank 72. A lower die 74 and clamping element 76 clamps a sheet metal blank 72 in place during the flange forming process. The roll former 92 initially contacts the distal end 78 of the sheet metal blank 72. The roll form is shifted on its rolling axis to the angular orientation shown in FIG. 4B. This causes distal end 78 of the sheet metal blank 72 to bend to a large radius that is gradually increased by rotating the axis of the roll former 92 to the position shown in FIG. 4C. The radius of the bend is gradually increased until it forms an over bend 86 as shown in FIG. 4C. Referring now to FIG. 4D, the roll former applies a compressive force to the flange as it is driven against the flange forming surface 90 forming the final flange 88 that has a sharp radius following the contour of the sharp radius on lower die 74.

Figure 5A:
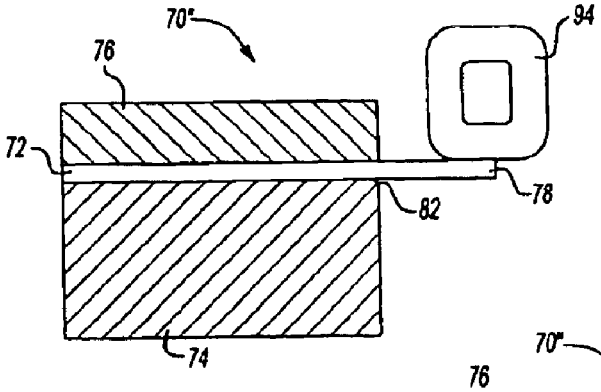
FIGS. 5A through 5D are schematic cross-sectional views that illustrate a process for forming a hem flange in a sheet metal blank using a hammer or other impact tool according to the present invention.
Figure 5B:
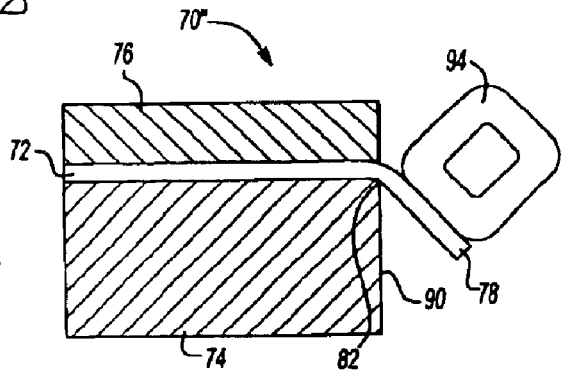
Figure 5C:
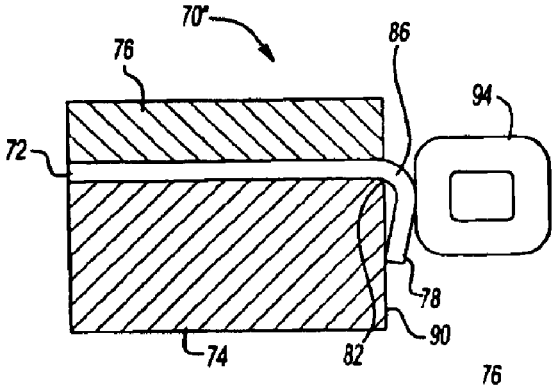
Figure 5D:
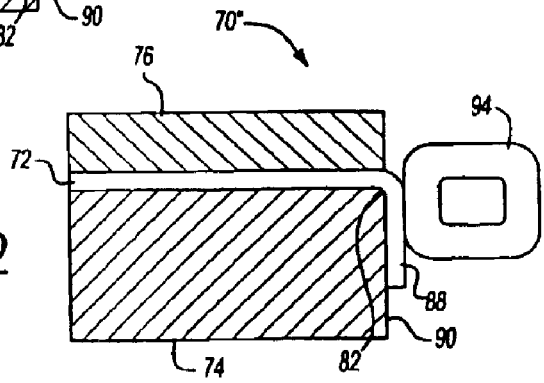

Referring now to FIGS. 5A through 5D, another alternative embodiment of a one step flange forming tool 70" is shown that is intended for low volume production applications. In this embodiment, a hammer 94 is used to form the sheet metal blank 72. The hammer 94 initially contacts the distal end 78 of the peripheral portion of a sheet metal blank 72 initially shown in FIG. 5A. Referring now to FIG. 5B, the hammer is shown forming a large radius around the bending radius 82 formed on the lower die 74. The hammer 94 applies a force on the sheet metal blank then gradually forms an over bend 86 as shown in FIG. 5C. The hammer 94 is then used to apply forming pressure to form the final flange 88 against the flange forming surface 90 with the final flange 88 being formed around the bending radius 82.

While the best mode for carrying out the invention has been described in detail, those familiar with the art to which this invention relates will recognize various alternative designs and embodiments for practicing the invention as defined by the following claims.

What is claimed is:

1. A method of forming a hem flange for securing a sheet metal outer panel to an inner panel, comprising:

retaining a sheet metal blank on a first die with a peripheral portion of the sheet metal blank initially extending outboard of a first flange forming portion, the first flange forming portion having a first supporting portion, a first flange pre-forming surface, and a first radiused portion;

moving a first bender in a direction normal to the sheet metal blank surface and into engagement with the peripheral portion of the sheet metal blank and bending the peripheral portion over the first radiused portion and against the flange pre-forming surface to form a sheet metal blank with a partially formed flange;

securing the sheet metal blank having a partially formed flange to a second die with the partially formed flange of the sheet metal blank initially extending outboard of a second flange forming portion, the second flange forming portion having a second supporting portion, a second flange forming surface and a second radiused portion, the second radiused portion being less than the first radius;

moving a second bender into engagement with the partially formed flange to form the partially formed flange against the second flange forming surface and around the second radiused portion by moving the second bender at an angle relative to the sheet metal blank surface that is at least partially directed toward the second flange forming surface.

2. A method of forming a hem flange, comprising:

clamping a sheet metal part having a body portion and a flange portion in a hem flange tool with the body portion clamped in the hem flange tool and the flange portion extending outboard of a flange forming portion of the hem flange tool, wherein the flange forming portion of the tool includes a flange forming surface and a radiused portion;

bending the flange portion to form a relatively large radius bend in the sheet metal part between the body portion and the flange portion by contacting the flange portion with a movable tool;

bending the flange portion around the radiused portion and against the flange forming surface to form the large radius bend into a sharp radius bend with the flange portion being disposed at a right angle relative to the body portion by moving the movable tool from a position outboard of the tool inwardly toward the hem flange tool.

3. The method of claim 2 wherein the movable tool used in the bending steps is a flange tool.

4. The method of claim 2 wherein the movable tool used in the bending steps is a roll former.

5. The method of claim 2 wherein the movable tool used in the bending steps is a hammer.

6. The method of claim 2 wherein the first bending step is performed by a flange tool that moves perpendicularly relative to the sheet metal surface.

7. The method step of claim 5 wherein the second bending step is performed by a flange tool that moves in an angular direction relative to the sheet metal surface.

8. The method step of claim 5 wherein the second bending step is performed by a flange tool that moves in a direction that is normal to a flange final forming surface.

9. A flanging tool for forming a hem flange, comprising:

a pre-form die having a flange pre-forming surface comprising a blank supporting surface, a flange pre-forming surface, and a first radius therebetween;

a pre-form flange punch having a first clamping portion that holds a sheet metal blank on the pre-form die and a first outer portion that moves relative to the pre-form die, the sheet metal blank having a peripheral portion that extends outboard of the pre-form die and the first clamping portion, the first outer portion of the pre-form flange punch engaging the peripheral portion of the sheet metal blank and forming a pre-form flange from the peripheral portion;

a flange die having a flange forming surface comprising a second blank supporting surface, a flange pre-form forming surface, and a second radius therebetween;

a flange punch having a second clamping portion that holds the sheet metal blank with the pre-form flange on the flange die and a second outer portion that moves relative to the flange die and the second clamping portion, the pre-form flange of the sheet metal blank extending outboard of the second flange supporting surface and the second clamping portion, the second outer portion engaging the pre-form flange and forming a flange on the blank.

10. The flanging tool of claim 9 wherein the first radius is two to three times the thickness of the sheet metal blank.

11. The flanging tool of claim 9 wherein the second radius is one-half of the thickness of the sheet metal blank.

12. The flanging tool of claim 9 wherein the first outer portion is a flange tool.

13. The forming tool of claim 12 wherein the second outer portion is a flange tool.

14. The flanging tool of claim 9 wherein the first outer portion is a roll former.

15. The forming tool of claim 14 wherein the second outer portion is a roll former.

16. The flanging tool of claim 9 wherein the first outer portion is a hammer.

17. The forming tool of claim 16 wherein the second outer portion is a hammer.

18. A method of forming a hem flange, comprising:

clamping a sheet metal part having a body portion and a flange portion in a hem flange tool with the body portion clamped in the hem flange tool and the flange portion extending outboard of the tool;

bending the flange portion to form a relatively large radius bend in the sheet metal part between the body portion and the flange portion by contacting the flange portion with a movable tool;

bending the flange portion to form the large radius bend into a sharp radius bend with the flange portion being disposed at a right angle relative to the body portion by moving the movable tool from a position outboard of the tool inwardly toward the hem flange tool;

wherein the large radius bend has a radius of two to three times the thickness of the sheet metal part.

19. A method of forming a hem flange, comprising:

clamping a sheet metal part having a body portion and a flange portion in a hem flange tool with the body portion clamped in the hem flange tool and the flange portion extending outboard of the tool;

bending the flange portion to form a relatively large radius bend in the sheet metal part between the body portion and the flange portion by contacting the flange portion with a movable tool;

bending the flange portion to form the large radius bend into a sharp radius bend with the flange portion being disposed at a right angle relative to the body portion by moving the movable tool from a position outboard of the tool inwardly toward the hem flange tool;

wherein the sharp radius bend has a radius of one-half of the thickness of the sheet metal part.

* * * * *